US005200984A

United States Patent [19]

Laeuffer

[11] Patent Number: 5,200,984

[45] Date of Patent: Apr. 6, 1993

[54] FILAMENT CURRENT REGULATOR FOR AN X-RAY TUBE CATHODE

[75] Inventor: Jacques Laeuffer, Paris, France

[73] Assignee: General Electric CGR S.A., Les Moulineaux, France

[21] Appl. No.: 744,416

[22] Filed: Aug. 13, 1991

[30] Foreign Application Priority Data

Aug. 14, 1990 [FR] France ..... 90 10349

[51] Int. Cl.[5] ..... H05G 1/34

[52] U.S. Cl. ..... 378/110; 378/101; 378/106; 378/107

[58] Field of Search ..... 363/17, 28; 378/91, 378/97, 101, 103, 104, 105, 106, 107, 108, 109, 110, 111, 112, 114

[56] References Cited

U.S. PATENT DOCUMENTS 3,916,251 10/1975 Hernandez et al. .
4,652,985 3/1987 Bouglé378 ..... 112/
4,694,480 9/1987 Skillicorn .
4,797,908 1/1989 Tanaka et al. ..... 378/105
5,001,618 3/1991 Laeuffer .

FOREIGN PATENT DOCUMENTS 137401 4/1985 European Pat. Off. .
192553 8/1986 European Pat. Off. .
241373 10/1987 European Pat. Off. .
3345036 6/1985 Fed. Rep. of Germany .
2247870 5/1975 France .

*Primary Examiner*—David P. Porta
*Attorney, Agent, or Firm*—Pollock, VandeSande & Priddy

[57] ABSTRACT

The disclosure relates to devices for supplying current to X-ray tube cathode filaments. The filament of a cathode is supplied with high-frequency current pulses given by a hyporesonant type DC/AC converter, the transistors of which are controlled by a regulation circuit. This regulation circuit carries out a high-frequency regulation.

2 Claims, 5 Drawing Sheets

FILAMENT CURRENT REGULATOR FOR AN X-RAY TUBE CATHODE

BACKGROUND OF THE INVENTION

1. Field of the Invention

The invention relates to a device for supplying current to a filament of a cathode of an X-ray tube and for regulating said current at a selected value.

An X-ray tube is generally constituted like a diode, i.e. it is constituted by two electrodes, one of which, called cathode, emits electrons while the other, called anode, receives these electrons on a small surface that constitutes the source of X-radiation.

The cathode has a heated filament that constitutes the electron source. When the high voltage, provided by a generator, is applied to the terminals of both electrodes so that the cathode is at a negative potential, a so-called anode current is set up through the generator and crosses the space between the cathode and the anode in the form of an electron beam. The intensity of this electron beam depends on the temperature of the filament, this temperature being a function of the power dissipated in the filament, i.e. a function of the current, called the heating current, that flows in the filament.

The quantity of X-rays emitted by the anode depends mainly on the intensity of the anode current and, hence, on the heating current of the filament. Thus, the heating current of the filament is one of the major parameters that have to be determined for each radiographic or radioscopic exposure during a radiological examination of a patient.

The parameters of the exposure are determined as a function of the nature of the examination. As a rule, these parameters are pre-determined by an operator who displays their values on a control panel used to control the operation of the different elements of a radiological installation, for example the high-voltage generator and the filament current generator. Increasingly, the values of these parameters are being determined by means of a microprocessor device that computes the optimum values of these parameters, for example, according to the type of examination desired by the practitioner and the specific features of the installation.

The parameters that are computed are, for example, the duration of the exposure time, the energy of the X-radiation through the choice of the value of the high voltage applied between the cathode and the anode and the intensity of the anode current through the choice, notably, of a value of the intensity of the heating current of the filament.

It must be noted that the heating current should be capable of being substantially modified between one exposure and the next one, for example from 1.5 amperes to 5.5 amperes, as well as during the exposure time. Furthermore, these current values should be obtained quickly and automatically, and should be maintained for the requisite time.

2. Description of the Prior Art

There are many devices for supplying and regulating the current used to heat a filament of an X-ray tube cathode. One of these devices is described in the French patent No. 2 597 285. This prior art device, the schematic diagram of which is given in FIG. 1, includes a current supply circuit 11 and a regulation circuit 12 (including circuit 8).

The supply circuit 11 comprises a DC voltage source 13 represented by a battery cell 13' and a DC/AC converter 14. The DC/AC converter 14 includes a chopper circuit 31 comprising two switches 20 and 21 controlled by a control circuit 19 and diodes 22 and 23, and a resonant circuit 10 comprising capacitors 24 and 25 and a coil 26. The resonant circuit 10 is connected to a primary winding 28 of an isolating transformer 9, the secondary circuit 27 of which includes the filament 15 of the cathode of the X-ray tube 30. The filament 15 is, if necessary, supplied by means of a rectifier circuit 29 which, for example, is of the type comprising rectifying diodes and filtering capacitors.

The regulation circuit 12 has a circuit 8 for detecting the heating current of the filament and a circuit 16 for the measurement of this heating current of the filament, a comparator circuit 17 for comparing the measured current with a predetermined value, known as a set-point value Ic, a voltage-frequency converter circuit 18, the output signals of which are applied to the DC/AC converter 14 so as to modify its frequency and thus obtain a heating current, the value of which is equal to the set-point value Ic.

The device briefly described hereabove has the following drawbacks. The quick turning-off of the transistors of the switches 20 and 21 of the DC/AC converter 14 gives rise to quick variations in the current. These quick variations create parasitic signals which disturb the surrounding circuits, notably the primary winding 28 of the transformer which includes the heating current detection circuit 8. The measurement signals thus include parasitic elements which create an error in the regulation circuit 12. When this error is reproducible, it may be corrected by calibration of the device.

Such reproducibility is possible only if the operating state is stable. This is obtained by a regulation of the voltage E of the source 13.

The quick turning-off of the transistors of the DC/AC converter 14 also has the effect that the current that flows in the filament 15 has a form that changes between the sinusoidal form and the sawtooth form when the voltage E of the source varies. Now, in the regulation circuit 12, it is provided for a computation of the effective current that characterises the temperature of the filament by squaring the measurement value. When the heating current approaches the sawtooth form, its squared value has peaks corresponding to high-order harmonics that the effective value measurement circuit cannot reproduce because its passband is insufficient. A known way of avoiding such a phenomenon is to regulate the voltage E of the voltage source 13.

SUMMARY OF THE INVENTION

An object of the present invention, therefore, is to provide for a supply circuit in which the steps of operation of the DC/AC converter include no quick stop of the current flowing in the semiconductors nor any waveform of the filament current exhibiting high harmonics.

To achieve this object, the invention proposes a DC/AC converter of the hyporesonant type with discontinuous operation wherein the switching frequency of the semiconductors of the DC/AC converter is smaller than the resonance frequency of the resonant circuit and wherein the semiconductors are turned off when the current in these semiconductors is null.

The invention therefore relates to a filament current regulator for an X-ray tube cathode comprising a circuit for the supply of current to said filament and a circuit for the regulation of said current, said supply circuit comprising:

a DC voltage source, a DC/AC converter to obtain current pulses from the DC voltage source, and an isolating transformer, the primary winding of which is connected to the output terminal of the DC/AC converter, wherein the DC/AC converter is of the hyporesonant type and generates high-frequency current pulses, and wherein the isolating transformer, which is of the pulse type, has its secondary winding directly connected to said filament of the cathode.

The regulation circuit of FIG. 1, corresponding to the prior art, has a substantial time delay between the application of a set-point value and the obtaining of this set-point value for the filament current. This time delay is due to the filtering introduced by the circuit for computing the effective value of the filament current in the measurement chain. Now, any filtering in the measurement chain is equivalent to a bypass in the direct chain. This bypass is a source of instability. To prevent this instability, the direct chain has a filtering system that greatly limits the passband of the automatic control loop. This results in the above-mentioned signal.

Another object of the present invention, therefore, is to design a regulation circuit that includes no filtering circuit in the measurement chain.

To achieve such an object, the measurement signal is squared and compared with the squared value of a set-point value, and it is therefore not necessary to use a circuit to compute the square root that a filtering circuit would have.

Thus, the regulation circuit according to the invention comprises:

a circuit for measuring the current I(t) in the filament, a circuit for computing the square $I_2(t)$ of the current I(t), a differentiator circuit for obtaining the difference $\epsilon$ between $I^2(t)$ and a signal $I_{ref}^2$ representing the square of the current $I_{ref}$ to be obtained in the filament, an integrator circuit for integrating the difference $\epsilon$, a comparator circuit for comparing the integrated signal with a threshold and to obtain an output signal as soon as the integrated signal goes beyond said threshold, a control circuit for controlling the DC/AC converter, said control circuit being controlled by the output signal of the comparator circuit and giving control signals for the switches of the DC/AC converter so as to create a current pulse in the primary winding of the transformer.

BRIEF DESCRIPTION OF THE DRAWINGS

Other objects, features and advantages of the invention shall appear from the following description of a particular exemplary embodiment of the invention, said description being made with reference to the appended drawings, of which.

DETAILED DESCRIPTION

Figure 1:
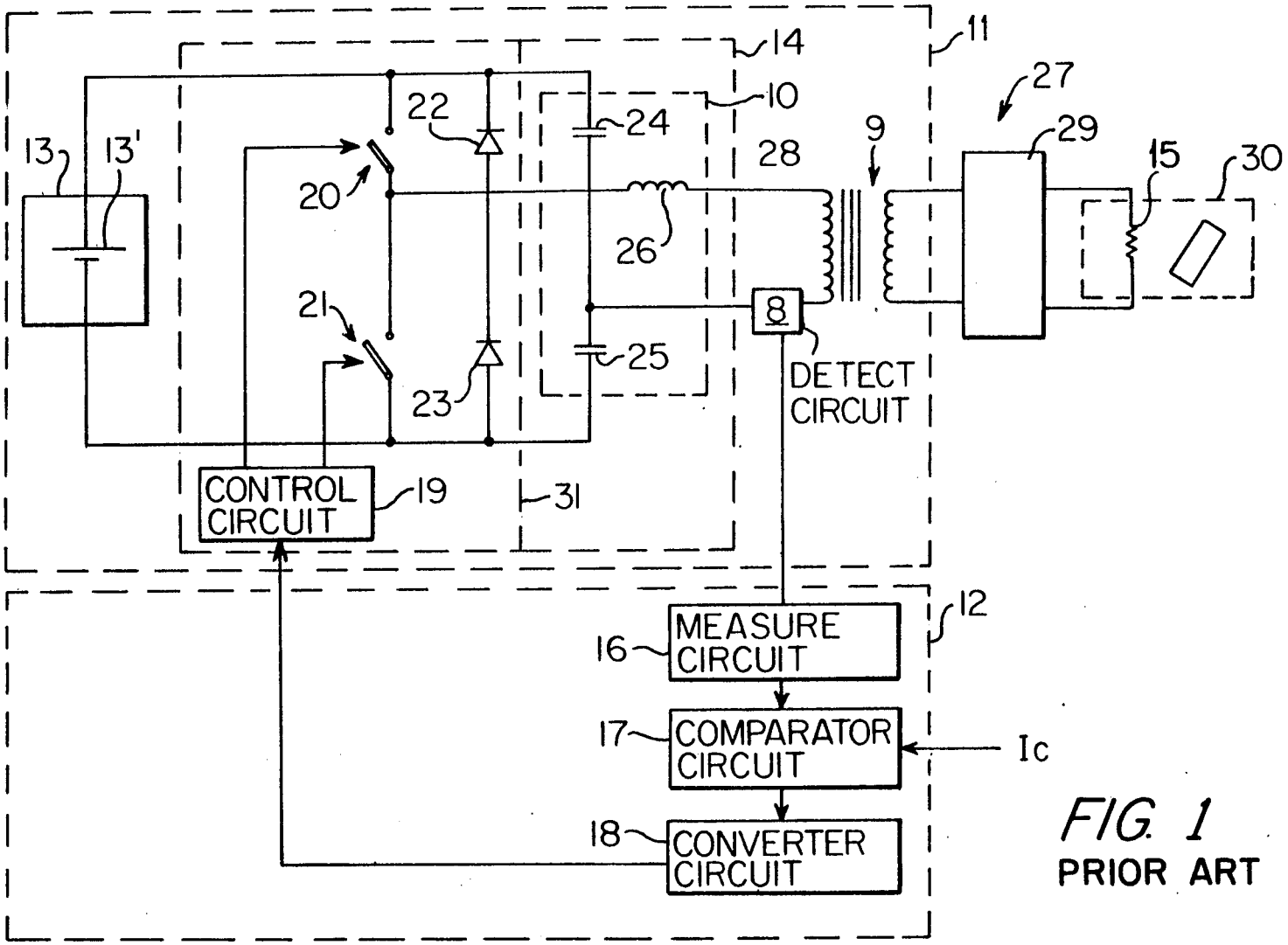
FIG. 1 PRIOR ART
FIG. 1 is a functional diagram of a device for the supply and regulation of the current of a filament of an X-ray tube cathode according to the prior art.

The diagram of FIG. 1 has been described briefly in the description of the prior art, to show certain drawbacks of filament current regulators for X-ray tube cathodes according to the prior art.

Figure 2:
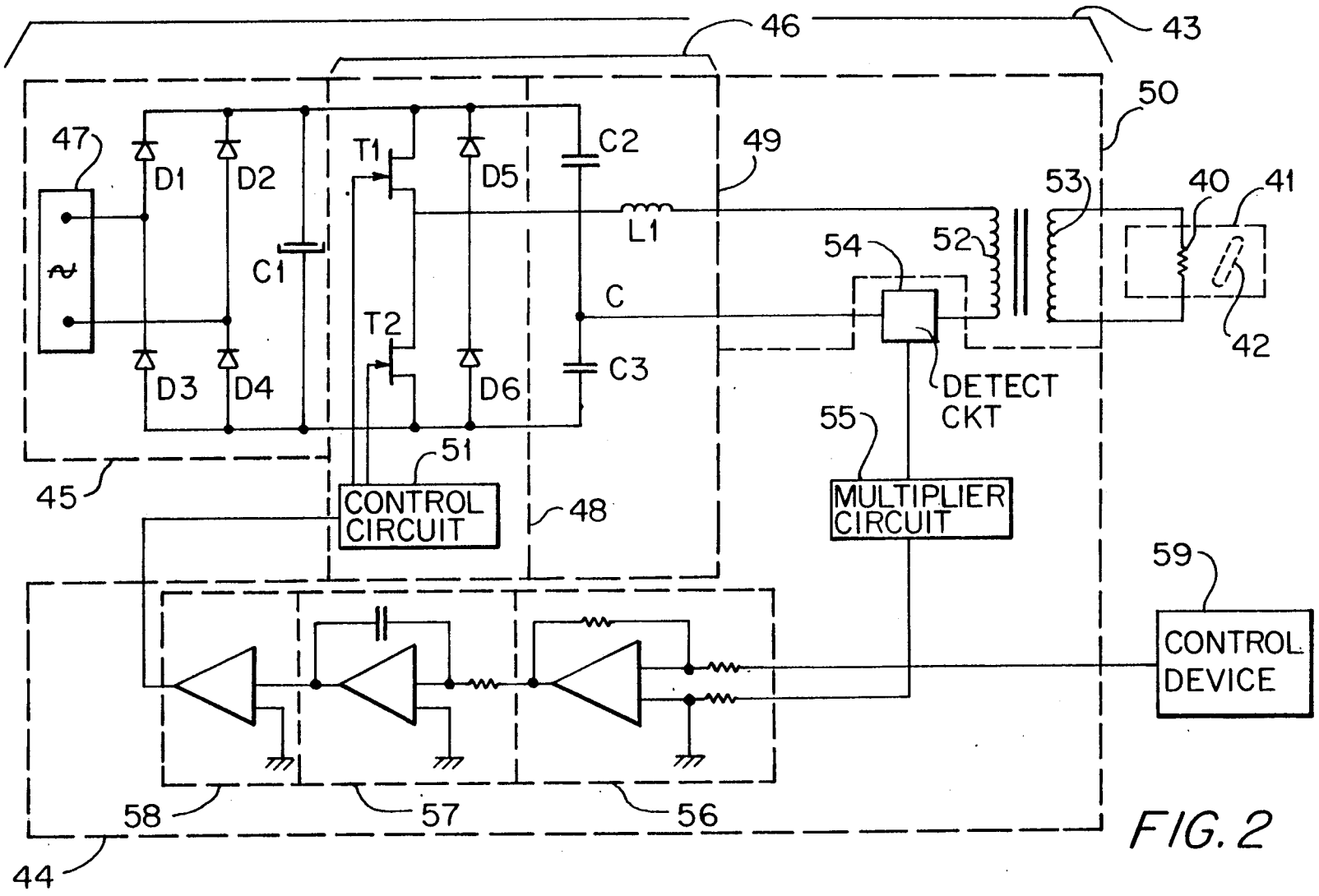
FIG. 2 is a functional diagram of a device for the supply and regulation of the filament current of an X-ray tube cathode according to the invention.

In FIG. 2, the device for the supply and regulation of the current of a cathode filament 40 of an X-ray tube 41, including an anode 42, comprises a current supply circuit 43 and a circuit 44 for the regulation of the current flowing in the filament 40. The supply circuit 43 includes a DC source 45, a DC/AC converter 46 and an isolating transformer 50.

The DC voltage source 45 may be of any known type without voltage regulation. It comprises, for example, an AC voltage source 47 that is connected to diodes D1 to D4 mounted in a full-wave rectifier bridge. The output terminals of the rectifier bridge are connected to the DC/AC converter 46 by means of a filtering cell that is constituted mainly by an electrolytic capacitor C1.

The DC/AC converter 46 includes a chopper circuit 48 and a resonant circuit 49.

The chopper circuit 48 comprises, for example, two field-effect transistors T1 and T2 which are series-connected between the output terminals of the supply circuit 45 and two diodes D5 and D6 which are respectively connected, in parallel, between the drain and the source of the transistors T1 and T2 so that their anode is connected to the source of the corresponding transistor. It also comprises a control circuit 51 for controlling the transistors T1 and T2.

The resonant circuit 49 comprises, for example, two capacitors C2 and C3, which are series-connected to the output terminals of the DC/AC converter 48 and a coil L1, one terminal of which is connected directly to the anode of the diode D5 while its other terminal is connected to the common point C of the capacitors C2 and C3 via a primary winding 52 of the transformer 50.

The isolating transformer 50 is of the pulse type. It comprises, in addition to the primary winding 52, a secondary winding 53, the output terminals of which are directly connected to the filament 40 of the cathode of the X-ray tube 41. It must be noted that, as compared with the diagram of FIG. 1, there is no rectifier circuit in the secondary circuit so that the filament 40 is supplied with pulsed current. However, the device according to the invention can be implemented if a rectifier circuit is connected between the secondary winding 53 and the filament 40.

The DC/AC converter 46 is of the hyporesonant type, i.e. the switching frequency of the transistors T1 and T2, as defined by the control circuit 51, is lower than the resonance frequency of the resonant circuit 49.

The regulation circuit 44 includes a circuit 54 for the detection and measurement of the heating current I(t) that is connected, for example, to the primary winding 52 of the transformer 50. The signal detected by this measuring circuit is applied to a multiplier circuit 55 that multiplies the input signal proportional to I(t) by itself so that the signal at the output terminal is proportional to $I^2(t)$. The output signal proportional to $I^2(t)$ is applied to an input terminal of a differentiator circuit 56 which also receives, at its other input terminal, a reference signal $I^2ref$ corresponding to the current $I_{ref}$ that it is desired to obtain in the filament 40. This signal $I^2ref$ is given by a control device 59. The error signal $\epsilon = I^2ref - I^2(t)$ is applied to an integrator circuit 57, the output signal of which is applied to a comparator 58, the reference potential of which is ground. The comparator 58 gives a pulse as soon as the integrated signal is, for example, greater than the potential of ground, and this pulse lasts up till the instant when said integrated signal becomes smaller than the potential of ground. This pulse, given by the comparator 58, is applied to the control circuit 51 to trigger the conduction of either one of the transistors T1 and T2 depending on whether the previously conductive transistor was T2 or T1.

Figure 3:
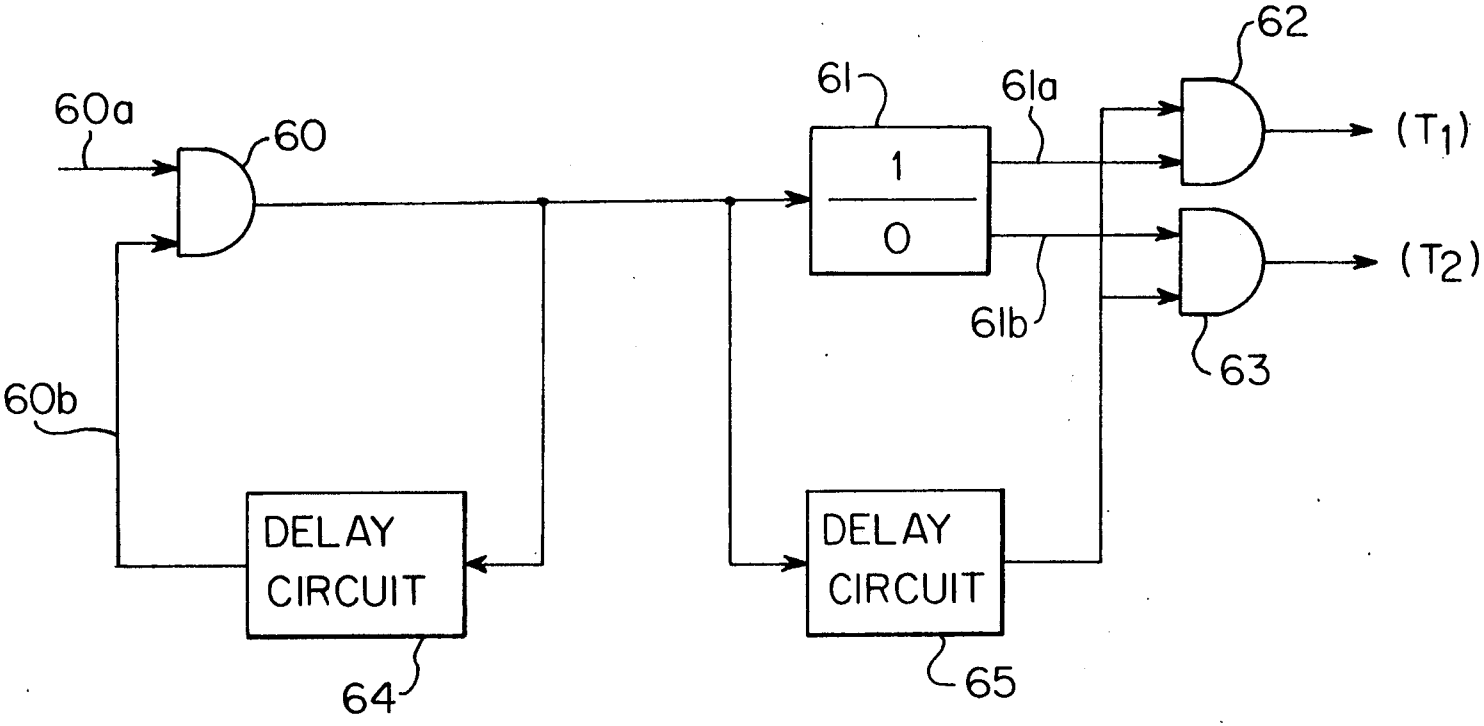
FIG. 3 is a simplified functional diagram of the control circuit 51 of the diagram of FIG. 2, and FIGS. 4*a* to 4*h* are graphs of signals as a function of time, useful for an understanding of the operation of the supply and regulation device according to the present invention.

FIG. 3 is a simplified functional diagram of the control circuit 51. This control circuit 51 includes a logic AND circuit 60, one input terminal 60*a* of which is connected to the output terminal of the comparator circuit 58 and the other input terminal, 60*b*, of which is connected to a delay circuit 64. The output terminal of the AND circuit 60 is connected, firstly, to an input terminal of a bistable circuit 61 and, secondly, to the input terminals of two delay circuits, one referenced 64 and the other referenced 65. The bistable circuit 61 has two output terminals 61*a* and 61*b*, the former corresponding to the state 1 and the latter to the state 0. These two output terminals 61*a* and 61*b* are respectively connected to one of the two output terminals of the logic AND circuits 62 and 63. The other input terminal of the AND circuits 62 and 63 is connected to the output terminal of the delay circuit 65.

The AND circuit 60 gives a control pulse to change the state of the bistable circuit 61 whenever the circuit 58 gives a pulse and whenever a certain time $\Theta_1$ has elapsed since the last pulse. This time $\Theta_1$ is obtained by means of the delay circuit 64.

The bistable circuit 61 provides the control signals for the transistors T1 and T2 by means of the AND circuits 62 and 63, the opening of which is controlled by the signal of the delay circuit 65 which determines the minimum period of conduction $\Theta_2$ of said transistors.

The values $\Theta_1$ and $\Theta_2$ may be 50 microseconds and 37 microseconds, respectively, if the maximum switching frequency is 20 kilohertz.

The operation of the supply and regulation device according to the invention shall now be explained with reference to FIGS. 2, 3 and 4, in assuming that a pulse T'1 (FIG. 4*g*) is applied at the instant to to the control electrode of the transistor T1. This signal T'1 turns the transistor T1 on and keeps it in this state, and a current $i_1$ (FIG. 4*a*), called a positive current, flows in the transistor T1, the coil L1, the primary winding 52 of the transformer 50, the capacitors C2 and C3 (in fact $i_1/2$ in each capacitor) and the source 45.

This current $i_1$ gives rise to a sinusoidal voltage V (FIG. 4*b*) at the terminals of the primary winding 52, and the result thereof is a current I(t) (FIG. 4*c*) in the secondary winding 53 of the transformer 50. This current has a shape identical to that of the current $i_1$ flowing in the primary winding.

The current $I_1$ charges the capacitor C3 and discharges the capacitor C2 and their charging voltage counters the flow of the current $i_1$ so that this current $i_1$ gets cancelled out at the instant $t_1$. The capacitor C3 then becomes discharged while the capacitor C2 becomes charged and a current $i_2$ (FIG. 4*a*), called a negative current, flows in the capacitors C2 and C3 (in fact $i_2/2$ in each capacitor), the primary winding 52, the coil L1, the diode D5 and the source 45. This negative current gives rise to a negative voltage (FIG. 4*b*) at the terminals of the primary winding 52 and, consequently, to a negative current I(t) (FIG. 4*c*) in the secondary winding 53. When the current $i_2$ gets cancelled out, the pulse is ended.

After a variable period of time, which is determined by the regulation circuit, a pulse T'2 is applied to the control electrode of the transistor T2 at the instant $t'_o$ to turn it on. A current $i'_1$, called a negative current, then flows in the transistor T2, the source 45, the capacitors C2 and C3 (in fact $i'_1/2$ in each capacitor), the primary winding 52 of the transformer 50 and the coil L1. This negative current gives rise to a negative voltage V (FIG. 4*b*) at the terminals of the primary winding 52, and the result thereof is a negative current I(t) (FIG. 4*c*) in the secondary winding 53 of the transformer 50. This current has a shape identical to that of the current $i'_1$ flowing in the primary winding.

The negative current $I'_1$ charges the capacitor C2 and discharges the capacitor C3, and their charging voltage counters the flow of the current $i'_1$ so that this current $i'_1$ gets cancelled out at the instant $t'_1$. The capacitor C2 then becomes discharged while the capacitor C3 becomes charged and a positive current $i'_2$ flows in the capacitors C2 and C3 (in fact $i'_2/2$ in each capacitor), the primary winding 52, the coil L1, the diode D6 and the source 45. This positive current gives rise to a positive voltage (FIG. 4*b*) at the terminals of the primary winding 52 and, consequently, to a positive current I(t) (FIG. 4*c*) in the secondary winding 53. When the current $i'_2$ gets cancelled out, the pulse is ended.

Figure 4A:
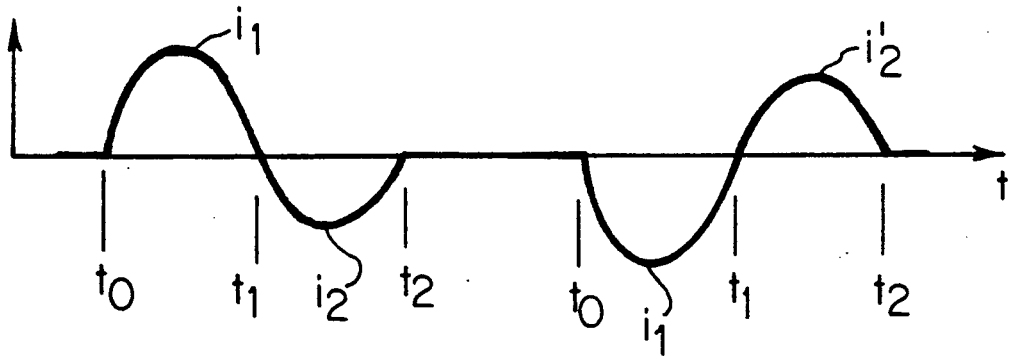
Figure 4B:
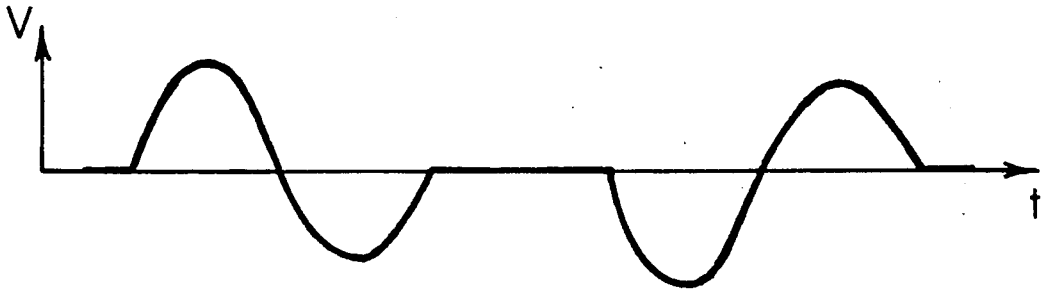
Figure 4C:
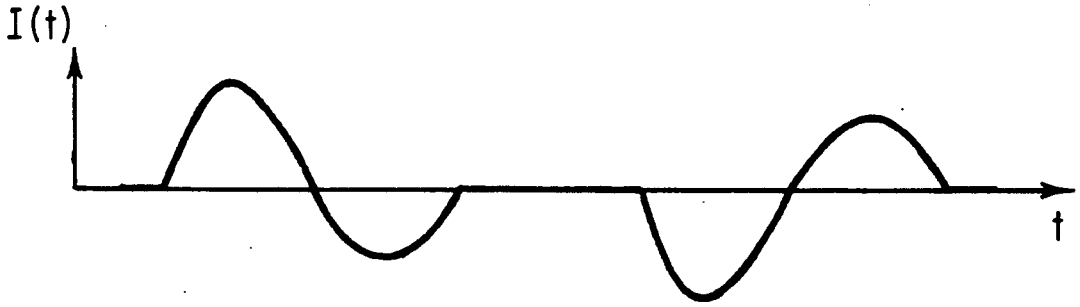
Figure 4D:
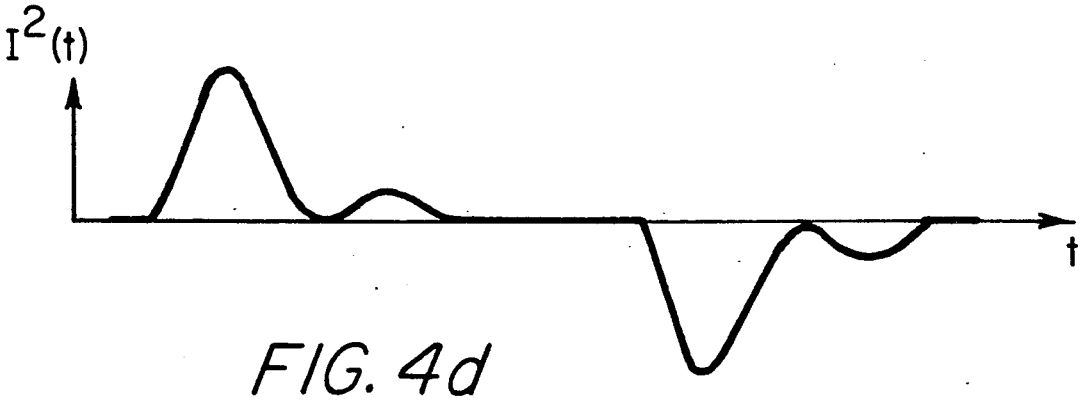
Figure 4E:
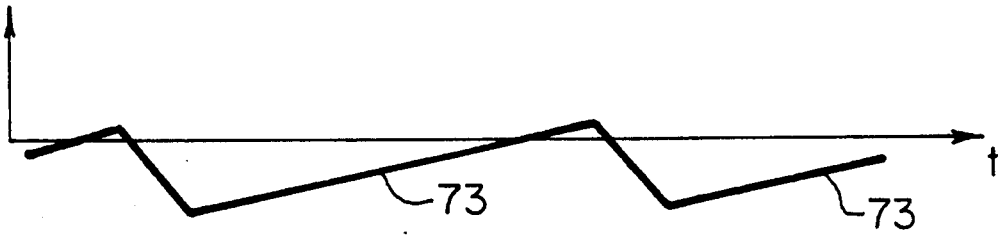
Figure 4F:
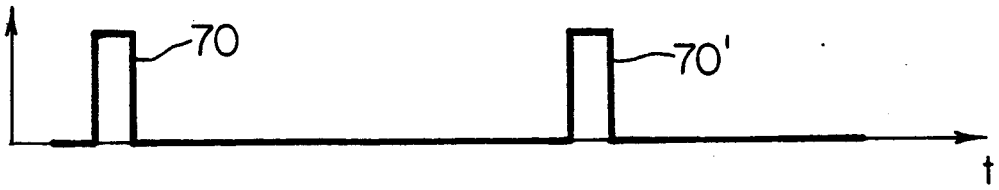
Figure 4G:
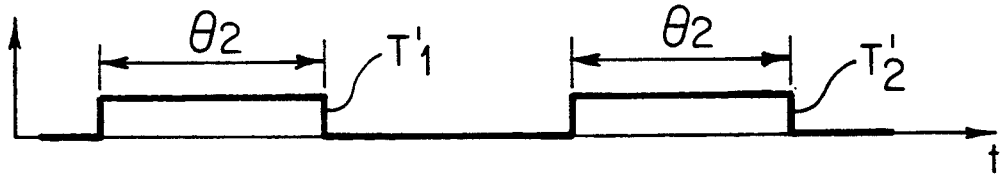
Figure 4H:
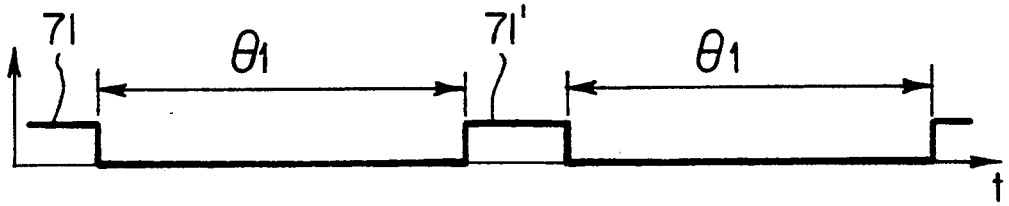

The control circuit 51, described in relation with FIG. 3, works as follows, in assuming that the transistor that has just been conductive is the transistor T2. When the circuit 58 provides the pulse 70 (FIG. 4*f*), its leading edge activates the change in the state (state 1) of the bistable circuit 61 via the AND circuit 60, provided that the second input terminal of this AND circuit receives the authorizing signal 71 (FIG. 4*h*) given by the delay circuit 64. The signal given by the AND circuit 60 zero-sets the two delay circuits 64 and 65 so that the AND circuit 60 closes during the period $\Theta_1$ (FIG. 4*h*) and the AND circuits 62 and 63 open during the period $\Theta_2$ (FIG. 4*g*). However, only the AND circuit 62, which receives the state 1 signal from the bistable circuit 61, gives a signal that turns the transistor T1 on. As indicated further above, the duration of this signal is determined by the duration $\Theta_2$ of the signal $T'_1$ given by the delay circuit 65, namely at least equal to the half-period of the maximum switching speed, so that the transistor T1 (or T2) is kept in the conductive state during the period $\Theta_2$. The signal $T'_1$ (or $T'_2$) therefore always ends after the instant $t_1$ (or $t'_1$).

A duration $\Theta_1$ after the pulse 70, the delay circuit 64 gives a signal 71' for the opening of the AND circuit 60 so that the next pulse 70' changes the state of the bistable circuit 61 which turns into state 0, ends the signal 71' by means of the delay circuit 64 and gives the signal T'2 by means of the delay circuit 65. The AND circuit 63 then gives a signal of a duration $\Theta_2$ which turns the transistor T2 on.

During the next cycle, the transistor T1 will be conductive, for the bistable circuit 61 returns to state 1.

The control circuit 51, described in relation with FIG. 3, has two delay circuits 64 and 65, but it is understood that it can be set up by means of only one delay circuit.

In the device for the supply and regulation of the filament current according to the invention, the regulation of the value of the current is obtained by alternating pulses of current which are substantially identical but inverted at each cycle, but the frequency of which varies to obtain the desired value $I_{ref}$. Thus, should $I_{ref}$ increase, the difference $\epsilon$ will increase and the slope (the part 73 in FIG. 4*e*) of the integrated signal will also increase so that the pulse 70' will appear a little earlier and will therefore trigger the transistor T2 earlier.

In the description of the operation of the DC/AC converter, it has been indicated that the currents $i_1$, $i_2$, $i'_1$ and $i'_2$ flow in the capacitors C2 and C3, but it is clear that each of these currents divides into two equal parts at the point C, one half flowing towards the arm containing the capacitor C2 and the other half flowing towards the arm containing the capacitor C3.

What is claimed is:

1. A filament current regulator for an X-ray tube cathode comprising a circuit for the supply of current to a filament and a circuit for the regulating of said current, said supply circuit comprising:

a DC voltage source;

a DC/AC converter for providing current pulses from said DC voltage source; and an isolating transformer the primary winding of which is connected to the output terminal of said DC/AC converter;

wherein said DC/AC converter is of the hyporesonant type and generates current pulses to said isolating transformer;

wherein said DC/AC converter is controlled by high-frequency pulses provided by a regulation circuit; and wherein said isolating transformer is of a pulse type having its secondary winding directly connected to said filament;

wherein said regulation circuit comprises:

a circuit for detecting the current I(t) in said filament;

a circuit for computing the square $I^2(t)$ of the current I(t);

a differentiator circuit for obtaining the difference $\epsilon$ between $I^2(t)$ and a signal $I^2ref$ representing the square of the current $I_{ref}$ to be obtained in said filament;

an integrator circuit for integrating the difference $\epsilon$;

a comparator circuit for comparing the integrated signal with a threshold and for obtaining an output signal as soon as the integrated signal goes beyond said threshold;

a control circuit for controlling said DC/AC converter, said control circuit being controlled by the output signal of said second comparator circuit and generating control signals for said DC/AC converter so as to generate current pulses in the primary winding of the transformer.

2. A device according to claim 1, wherein said control circuit comprises:

a first AND circuit, one of the two input terminals of which is connected to the output terminal of said comparator circuit;

a bistable circuit, the control input terminal of which is connected to the output terminal of said first AND circuit so as to change state at each signal given by said first AND circuit;

a second AND circuit, one of the two input terminals of which is connected to the output terminal of said bistable circuit corresponding to the state 1;

a third AND circuit, one of the two input terminals of which is connected to the output terminal of said bistable circuit corresponding to the state 0;

a first delay circuit, the input terminal of which is connected to the output terminal of said first AND circuit and the output terminal of which is connected to said second input terminal of said first AND circuit; and a second delay circuit, the input terminal of which is connected to the output terminal of said AND circuit and the output terminal of which is connected to the other input terminal of said second and third AND circuits.

* * * * *

UNITED STATES PATENT AND TRADEMARK OFFICE

CERTIFICATE OF CORRECTION

PATENT NO. : 5,200,984

DATED : April 6, 1993

INVENTOR(S) : Jacques Laeuffer

It is certified that error appears in the above-identified patent and that said Letters Patent is hereby corrected as shown below:

Column 3, line 38, change "$I_2(t)$" to --$I^2(t)$--.

Column 3, line 41, change "$I_{ref}{}^2$" to --$I^2$ref--.

Column 5, line 49, delete "to" (second occurrence).

Column 7, line 23, change "regulating" to --regulation--.

Signed and Sealed this

Twenty-fifth Day of January, 1994

*Attest:*

Bruce Lehman

BRUCE LEHMAN

*Attesting Officer*

*Commissioner of Patents and Trademarks*